US005205143A

United States Patent [19]

Hakkarainen et al.

[11] Patent Number: 5,205,143

[45] Date of Patent: Apr. 27, 1993

[54] CYLINDER LOCK

[75] Inventors: Reijo Hakkarainen; Seija Rämö; Kaarlo Martikainen; Kyösti Nevalainen, all of Joensuu, Finland

[73] Assignee: Abloy Security Ltd Oy, Helsinki, Finland

[21] Appl. No.: 792,294

[22] Filed: Nov. 14, 1991

[30] Foreign Application Priority Data

Nov. 30, 1990 [FI] Finland ..... 905909

[51] Int. Cl.[5] ..... E05B 29/08

[52] U.S. Cl. ..... 70/366; 70/377; 70/419

[58] Field of Search ..... 70/366, 365, 356, 377, 70/405–407, 409, 419–421

[56] References Cited

U.S. PATENT DOCUMENTS

| | | | |
|---|---|---|---|
| 2,613,528 | 10/1952 | Salmivuori | 70/419 X |
| 3,797,290 | 3/1974 | Taylor | 70/366 |
| 3,821,886 | 7/1974 | Ladewig | 70/366 |
| 3,928,992 | 12/1975 | Talbot | 70/366 |
| 3,948,065 | 4/1976 | Martikainen | 70/366 |
| 4,008,588 | 2/1977 | Miller et al. | 70/366 |
| 4,083,212 | 4/1978 | Proefrock | 70/366 |
| 4,267,717 | 5/1981 | Martikainen | 70/366 |
| 4,512,166 | 4/1985 | Dunphy et al. | 70/366 |
| 4,686,843 | 8/1987 | Martikainen et al. | 70/366 |
| 4,742,703 | 5/1988 | DeWalch et al. | 70/366 |

*Primary Examiner*—Peter M. Cuomo

*Assistant Examiner*—Suzanne L. Dino

*Attorney, Agent, or Firm*—Dellett, Smith-Hill and Bedell

[57] ABSTRACT

A cylinder lock comprising a lock body (1) and inside it a rotatable lock cylinder (2) enclosing a number of locking discs (4;6) turnable by the key (3) of the lock and provided with a peripheral notch (8) determining the combination of the lock, and a locking bar (7), which in the locking position prevents turning of the lock cylinder (2) with regard to the lock body (1). The locking discs (4) are also provided with a set of second peripheral notches (10) arranged in cooperation with an auxiliary bar (11) so as to prevent turning of the locking discs (4;6) relatively to each other at the end phase of the turning movement for opening the lock before the locking bar (7) moves into its position for releasing the lock. The second peripheral notches (10) are located outside of the cutting range for said combination peripheral notches (8) and are arranged side by side on the peripheral edge of each of the locking discs (4). Their number corresponds to the number of the possible cuts for the combination peripheral notch (8), and the pitch between them corresponds to the mutual pitch between the combination peripheral notches (8). The auxiliary bar (11) is continuously located partly inside the lock cylinder (2) and limits the turning range of the locking discs (4;6). The lock includes further at least one member continuously turning with the key (3) for guiding the radial movement of the auxiliary bar (11).

21 Claims, 4 Drawing Sheets

Figure 1:
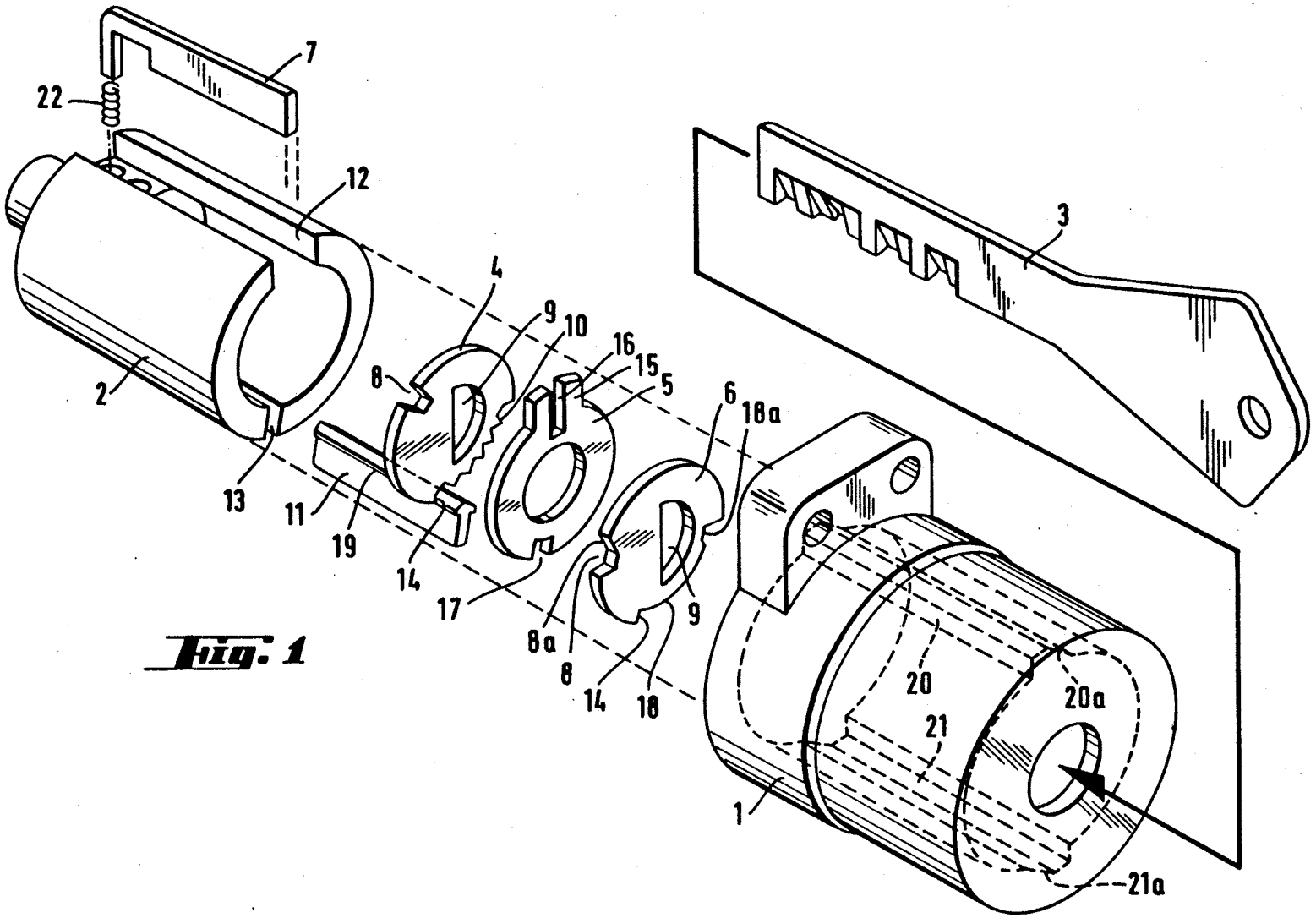

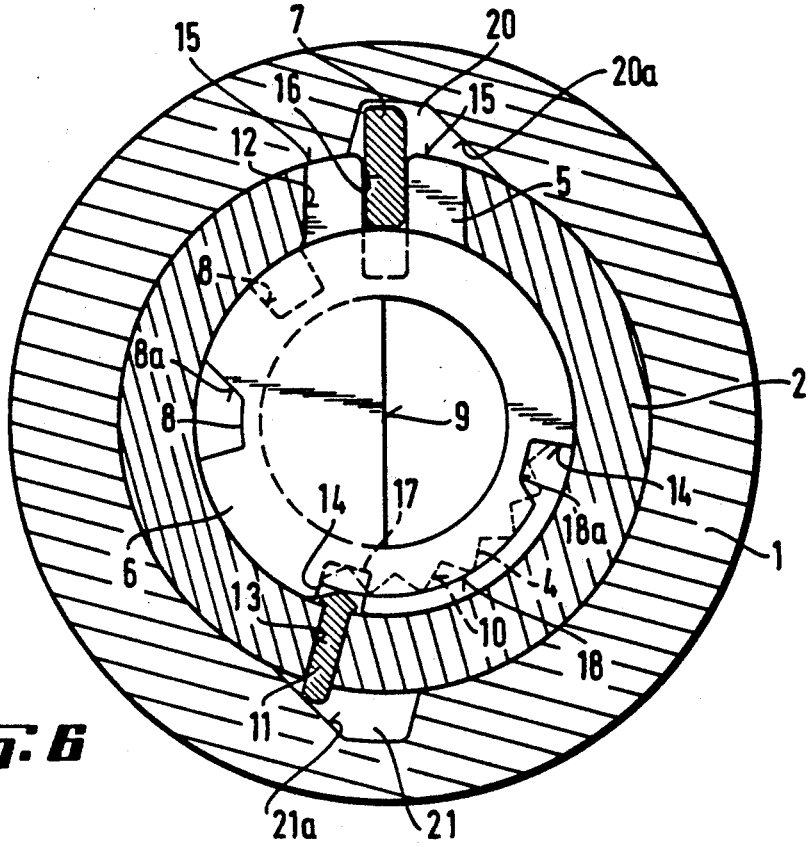
Fig. 6
Fig. 7
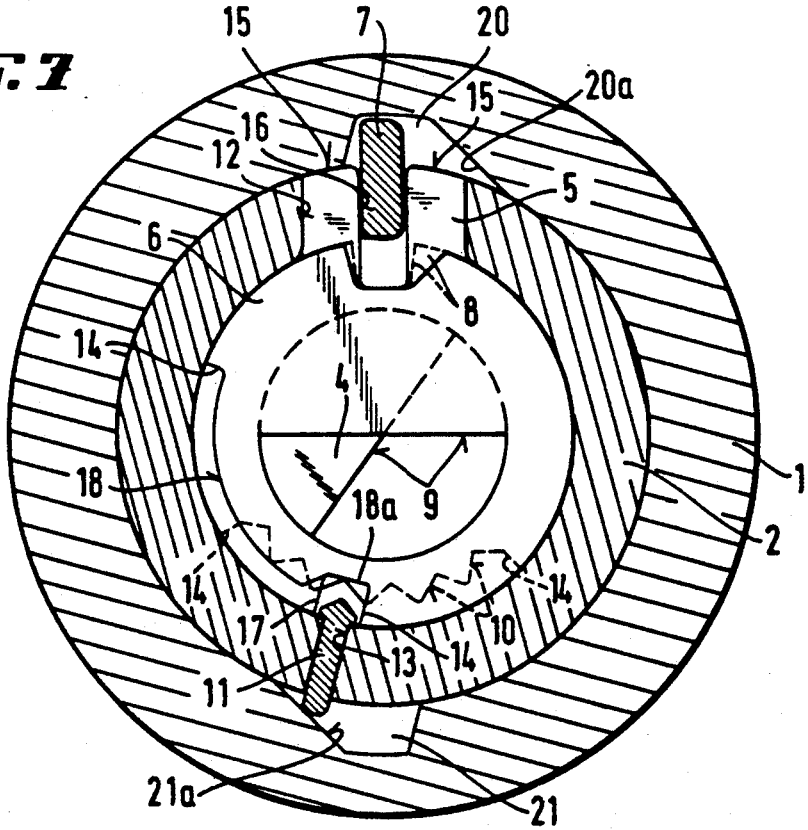

CYLINDER LOCK

The invention relates to a cylinder lock.

A cylinder lock of the kind is known from the U.S. Pat. No. 2,613,528 discloses a cylinder lock that comprises, in addition to a locking bar, a separate auxiliary bar, the purpose of which is to lock the locking discs to be mutually unturnable slightly before the locking discs are turned into a position, in which they allow the locking bar to move into a position releasing the inner cylinder to turn with regard to the lock body. Hereby detection of the correct opening combination through trial by probing and turning individual locking discs one after another is prevented.

According to this known arrangement both the peripheral notches determining the opening combination of the lock and the peripheral notches for the auxiliary bar are identical and are located in the same area on the peripheral edge of the locking discs. The very purpose is that they are applicable for either of the bars. As a result the auxiliary bar does not block the locking discs to be unturnable for all the combinations of the peripheral notches, whereby it is not able to prevent casual false openings either, resulting from wear and more spatial tolerances of manufacture, by means of keys differing only slightly from the correct combination of the lock mechanism. A further essential drawback is the fact that the masterkeying properties of the locks according to this old arrangement do not fulfill current requirements.

The purpose of the invention is to create an improved cylinder lock based on rotatable locking discs and from which the drawbacks appearing in the known arrangement referred above are eliminated, and which effectively prevents false openings as well as picking of the lock by probing and turning individual locking discs. At the same time an aim is to create a locking mechanism the construction of which is advantageous and secure as to its operation and which can flexibly be employed in rotatable locking disc based cylinder locks of different size and type.

In accordance with the invention, second peripheral notches are located outside of the cutting range for said combination peripheral notches of the locking discs and are arranged side by side on the peripheral edge of each of the locking discs so that their number correspond to the number of the possible cuts for the combination peripheral notch, and the pitch between them correspond to the mutual pitch between the combination peripheral notches. In addition said auxiliary bar is arranged to be continuously located partly inside the lock cylinder so that it simultaneously limits the turning range of the locking discs. The lock includes further at least one member continuously turning with the key and guiding the radial movement of the auxiliary bar. Hereby an uncomplicated and operationally secure arrangement can be achieved for the mutual guidance of the auxiliary bar and the locking discs. In addition it is secured that the locking bar and the auxiliary bar keep functionally apart, whereby the drawbacks in the known art can be eliminated. As in practice said pitch between the peripheral notches is generally 18°, a uniform channel formed by said second peripheral notches and corresponding even to small differences in the turning angle of the separate locking discs can be provided for the auxiliary bar so that it can move into said channel and, thus, block the locking discs to be mutually unturnable, which forwards prevention of false openings.

In practice guidance for the locking discs can with advantage be implemented so that on either side of the peripheral edge area corresponding to said second peripheral notches of the locking disc there is a guide surface, which is arranged to cooperate with the auxiliary bar for limiting the turning range of the locking disc. For this purpose said auxiliary bar is formed so that its movement through the slot in the lock cylinder entirely into the groove in the lock body is prevented. For instance the part of the auxiliary bar remaining continuously inside the lock cylinder can be formed so as to comprise protrusions or the like so that the breadth of the auxiliary bar exceeds the breadth of said slot in the lock cylinder.

Said member guiding the radial movement of the auxiliary bar is advantageously a so called O-locking disc, which is even otherwise generally utilized in the lock type the invention is directed to in the both ends of the stack of discs thereof so as to make the operation of the mechanism more smooth. According to the invention the peripheral edge of the O-locking disc is provided with a groove, the breadth of which corresponds to the breadth of the peripheral edge area determined by said second peripheral notches in each locking disc and which allows movement of the auxiliary bar into a channel formed jointly in each case by said second peripheral notches of the locking discs only after turning of the O-locking disc close to its position corresponding to the opening of the lock mechanism.

For providing the required anticipation for the function of the auxiliary bar in comparison with the locking bar, in practice the O-locking disc is arranged to allow movement of the auxiliary bar into the channel formed jointly by said second peripheral notches of the locking discs when the O-locking disc is at the turning angle of 10°–20°, preferably of about 15° from the position corresponding to the opening of the lock mechanism.

For securing the operation of the auxiliary bar the groove in the inner surface of the lock body is formed to include a guide surface, which is arranged to press the auxiliary bar radially inward into the channel formed jointly by said second peripheral notches of the locking discs.

The cross section of the auxiliary bar is with advantage smaller than that of the locking bar, whereby the arrangement according to the invention can more easily be employed also in locks, which utilize different, smaller size locking discs.

Correspondingly, the second peripheral notches of the locking discs can with advantage differ from the combination peripheral notches as to their form, and preferably they are smaller than the combination peripheral notches. Also the movement of the auxiliary bar in the radial direction of the stack of discs is in this case essentially shorter than the corresponding radial movement of the locking bar.

Figure 2:
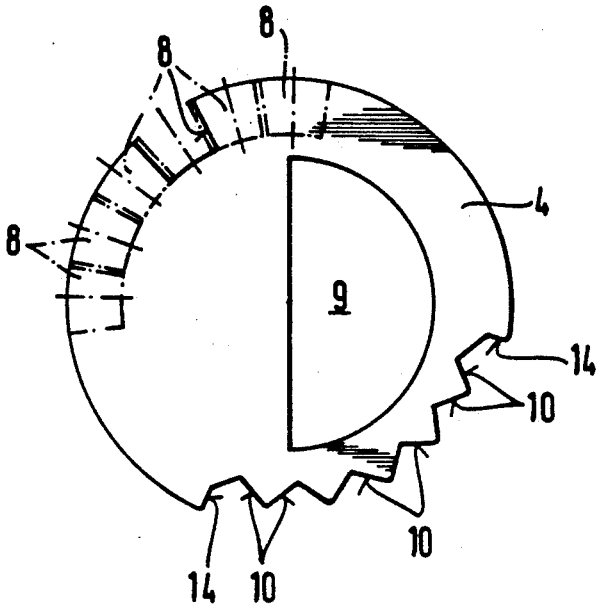
Figure 3:
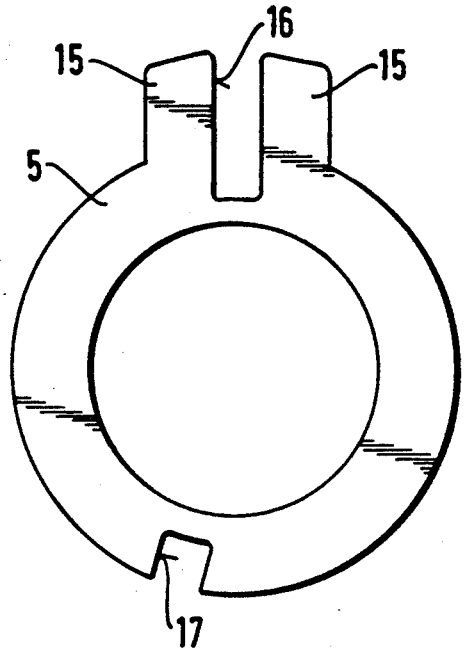
Figure 4:
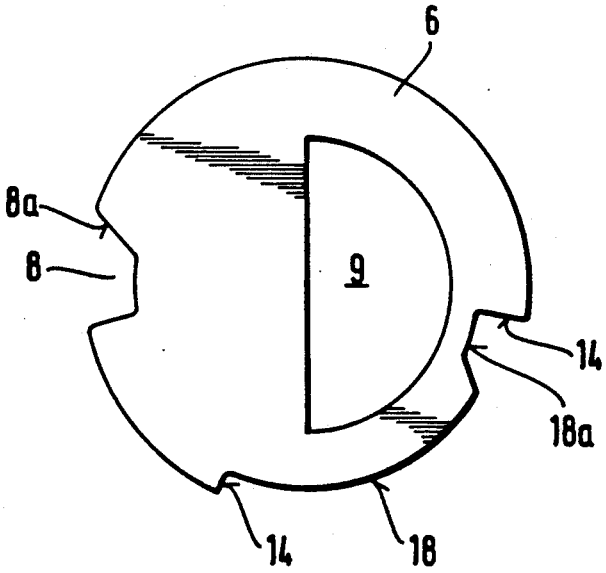
Figure 5:
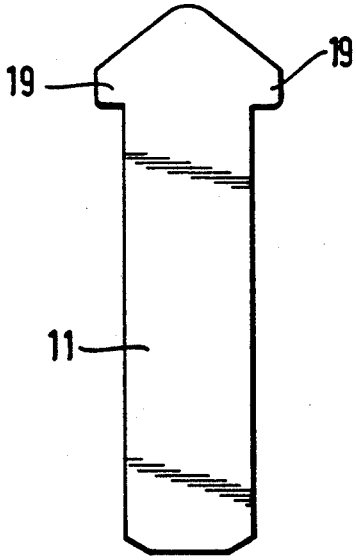
Figure 8:
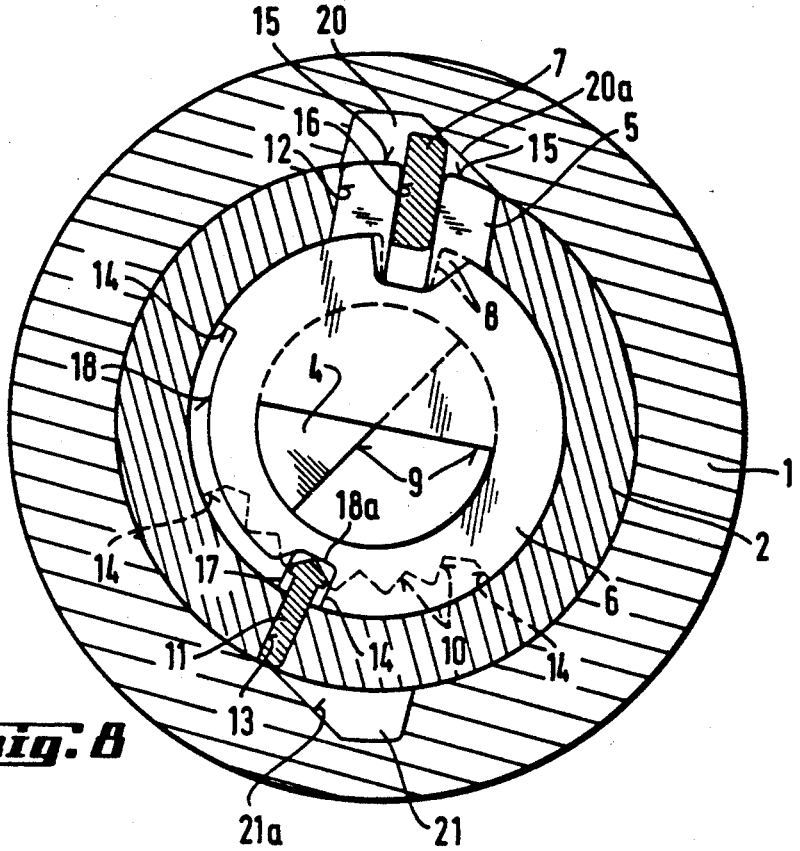
Figure 9:
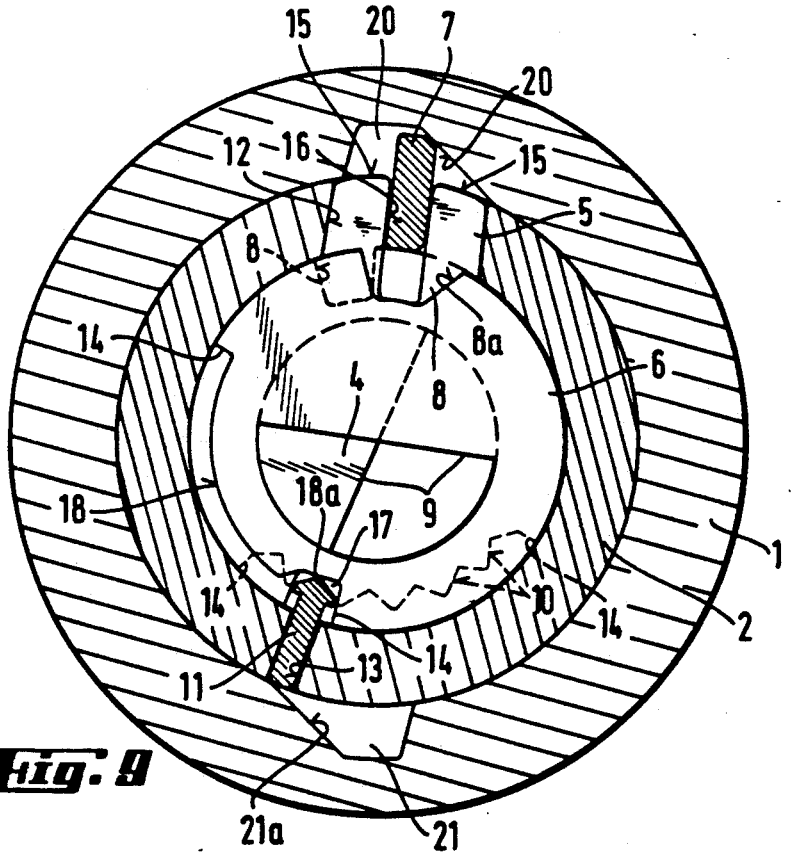

In the following the invention is described more in detail with reference to the attached drawing, in which FIG. 1 shows exploded view of a lock according to the invention, FIG. 2 shows a locking disc in a lock according to the invention, FIG. 3 shows an intermediate disc in a lock according to the invention, FIG. 4 shows a so called O-locking disc in a lock according to the invention, FIG. 5 shows a locking bar in a lock according to the invention viewed from the end, FIGS. 6–9 show a lock according to the invention as a sectional view and in different operating positions so that FIG. 6 shows the lock in the locking position, FIG. 7 shows the lock at the moment of selecting of the correct combination, FIG. 8 shows the situation a bit later when the lock is opening, and FIG. 9 shows the situation after selecting an incorrect combination.

In the drawing the reference numeral 1 indicates a lock body, inside of which there is a turnable lock cylinder 2 enclosing for its part a stack of discs including a number of locking discs 4 and, arranged between them, intermediate discs 5. In addition at both ends of the stack of discs there is a so called O-locking disc 6, which turns continuously when the key is turned in the lock; this is because the cut for corresponding combination surface or force transmission surface in the key is a 0 -cut. In principle these O-locking discs can be located also elsewhere in the stack of discs.

The lock includes also a locking bar 7, which in the locked position of the locking mechanism is located partly in a groove 20 in the inner surface of the lock body 1 and partly in a slot 12 in the lock cylinder 2 thereby preventing turning of the lock cylinder 2 with regard to the lock body 1 (cf. FIG. 6). As more clearly apparent from FIGS. 3 and 6 in practice the locking bar 7 is not directly in contact with the slot 12 in the lock cylinder 2, but through protrusions 15 in the intermediate discs 5 forming a groove 16 for the locking bar 7. At the same time the protrusions 15 support the intermediate discs 5 so as to be unturnable with regard to the lock cylinder 2.

All the locking discs include a key opening 9 and at least one peripheral notch 8 determining the opening combination of the lock and which can have six different locations as shown by dotted lines in FIG. 2. The locking discs 4 are turnable by means of the key 3 of the lock into a position, in which the peripheral notches 8 form at the position of the slot 12 in the lock cylinder 2 and the locking bar 7 a uniform channel, into which the locking bar 7 moves, pressed by a guide surface 20*a* in the groove 20 as apparent from FIGS. 7 and 8, thereby releasing the lock cylinder 2 to turn with regard to the lock body 1. Correspondingly, when the lock is being locked a guide surface 8*a* in the peripheral notch of the O-locking discs 6 assisted by a spring 22 presses the locking bar 7 back into the groove 20 in the lock body 1, whereby smooth operation of the lock mechanism is ensured.

In addition to the conventional lock operation and the conventional locking members described above the lock is provided with an auxiliary bar 11, for which the locking discs 4 are provided with a set of second peripheral notches 10, which are arranged side by side on a different area on the peripheral edge of the locking discs than the actual peripheral notches 8 determining the lock combination. The mutual pitch between the peripheral notches 10, however, corresponds to the pitch between the possible cuts for the peripheral notches 8 (cf. FIG. 2), which is conventionally 18°. The intermediate discs 5 include a groove 17 for the auxiliary bar 11, respectively.

The auxiliary bar 11 is provided with protrusions 19 (cf. FIG. 5) so that it is continuously located partly inside the lock cylinder 2 in a second slot 13 arranged in the lock cylinder 2 and gets only partly into a groove 21 in the lock body 1 as apparent from FIGS. 6–9. Hence, at the same time the auxiliary bar 11 serves as a limiting member for the turning of the locking discs. For this purpose the locking discs include guide surfaces 14 (FIGS. 2 and 4). The radial movement of the auxiliary bar 11 inside the lock cylinder 2 is guided by a groove 18 in the O-locking discs 6. The groove 18 prevents the auxiliary bar 11 from moving into contact with the peripheral notches 10 in the locking discs until the O-locking discs 6 are turned close to the opening position of the locking mechanism, whereby a depression 18*a* in the groove 18 is located at the position of the auxiliary bar 11. Then a guide surface 21*a* in the groove 21 presses the auxiliary bar 11 radially inward, whereby mutual turning of the locking discs is prevented.

The mutual location of the locking bar 7 and the auxiliary bar 11 is selected so that the auxiliary bar 11 moves radially inward into the groove formed jointly by the peripheral notches 10 about 15° before the locking bar 7, pressed by the guide surface 20*a* in the groove 20, attempts to move into the releasing position of the locking mechanism, cf. FIGS. 6–8.

As illustrated in FIG. 9 blocking of the mutual turning of the locking discs by the auxiliary bar 11 prevents false openings also in such situations when, for instance due to spatial tolerances and wear, some locking disc might by chance be able to turn into the position for releasing the locking bar also when turned with an incorrect key with a combination close to the correct one. Similarly the auxiliary bar 11 prevents the correct combination to be searched by turning the individual locking discs one after another.

Naturally, the form of the edge of the auxiliary bar 11 as well as the form of the peripheral notches 10 of the locking discs can differ from the one shown in the figures, as long as the forms are mutually compatible and selected so that the auxiliary bar is partly located inside the lock cylinder 2 all the time. Also the anticipation selected for the operation of the auxiliary bar 11 when the lock is being opened may be varied in some degree, it can be for instance 10°–20°.

In some versions of this lock type, in which the opening movement can be fairly long and, thus, the turning angle for the lock cylinder 2 rather wide, the locking bar 7 may also get into the groove 21 for the auxiliary bar 11 when the lock is being locked. This poses no problem and for this reason the grooves 20 and 21 are made similar in the embodiment shown in the figures.

The invention is not limited to the embodiment shown, but several modifications are feasible within the scope of the attached claims.

We claim:

1. A cylinder lock comprising:

a lock body having an interior surface formed with first and second grooves, a rotatable lock cylinder inside the lock body, the lock cylinder being formed with first and second slots, a plurality of locking discs enclosed by the lock cylinder, each locking disc having a key engagement surface that is engaged when the key of the lock is inserted in the lock and is turned, and also having a peripheral locking notch that is at one of a predetermined number of permitted angular positions relative to the key engagement surface of the disc, the permitted angular positions all being within a predetermined angular range and being at a predetermined angular pitch within said angular range, and each locking disc also having a set of second peripheral notches arranged side by side and located outside said predetermined angular range, the number of second peripheral notches in each locking disc being equal to said predetermined number and the angular pitch between the second peripheral notches being substantially equal to said predetermined angular pitch, a locking bar, which in the locked position of the lock is located partly in the first groove in the lock body and partly in the first slot in the lock cylinder and thereby prevents turning of the lock cylinder relative to the lock body, an auxiliary bar, which in the locked position of the lock is located partly in the second groove in the lock body and partly in the second slot in the lock cylinder, the set of second peripheral notches of each locking disc being arranged in cooperation with said auxiliary bar so that when the locking discs are turned in the opening direction of the lock, said auxiliary bar and said second peripheral notches prevent turning of the locking discs relative to each other at the end phase of the turning movement before the locking bar moves into its position for releasing the lock, and said auxiliary bar being continuously located partly inside the lock cylinder so that it limits the turning range of the locking discs, and at least one member continuously turning with the key and arranged to guide radial movement of the auxiliary bar.

2. A cylinder lock according to claim 1, wherein the second peripheral notches of each locking disc are located between guide surfaces that cooperate with the auxiliary bar for limiting the turning range of the locking disc.

3. A cylinder lock according to claim 1, wherein the auxiliary bar is formed so that it cannot move through the second slot in the lock cylinder entirely into the second groove in the lock body.

4. A cylinder lock according to claim 3, wherein the part of the auxiliary bar that is continuously located inside the lock cylinder is formed with protrusions so that the tangential extent of said part of the auxiliary bar exceeds the tangential extent of the second slot in the lock cylinder.

5. A cylinder lock according to claim 1, wherein the member for guiding radial movement of the auxiliary bar is a O-locking disc having a peripheral relief of which the tangential extent corresponds to the tangential extent of the set of second peripheral notches in each locking disc that has a set of second peripheral notches, and wherein the peripheral relief allows movement of the auxiliary bar into a channel jointly formed by said second peripheral notches of the locking discs only after turning of the O-locking disc close to the position for releasing the lock.

6. A cylinder lock according to claim 5, wherein the O-locking disc allows movement of the auxiliary bar into the channel formed jointly by the second peripheral notches of the locking discs when the O-locking disc is at an angle in the range from about 10° to 20° from the position for releasing the lock.

7. A cylinder lock according to claim 5, wherein the O-locking disc allows movement of the auxiliary bar into the channel formed jointly by the second peripheral notches of the locking discs when the O-locking disc is at an angle of about 15° from the position for releasing the lock.

8. A cylinder lock according to claim 5, comprising first and second O-locking discs, and wherein the locking discs having second peripheral notches are between the first and second O-locking discs.

9. A cylinder lock according to claim 1, wherein the second groove of the lock body has a guide surface for pressing the auxiliary bar radially inwards into a channel formed jointly by the second peripheral notches of the locking discs.

10. A cylinder lock according to claim 1, wherein the cross section of the auxiliary bar is smaller than that of the locking bar.

11. A cylinder lock according to claim 1, wherein the second peripheral notches of each locking disc are different in shape from the peripheral locking notch of the locking disc.

12. A cylinder lock according to claim 11, wherein the second peripheral notches are smaller than the peripheral locking notches.

13. A cylinder lock according to claim 1, wherein the range of movement of the auxiliary bar in the radial direction is substantially less than the range of movement of the locking bar in the radial direction.

14. A cylinder lock comprising:

a lock body having an interior surface formed with first and second grooves, a rotatable lock cylinder inside the lock body, the lock cylinder being formed with first and second slots, a plurality of locking discs enclosed by the lock cylinder, each locking disc having a key engagement surface that is engaged when the key of the lock is inserted in the lock and is turned, and also having a peripheral locking notch that is at one of six angular positions relative to the key engagement surface of the disc, the six angular positions all being within an angular range of 90° and being at an angular pitch of 18° within said angular range, and each locking disc also having a set of six second peripheral notches arranged side by side outside said angular range at an angular pitch of about 18°, a locking bar, which in the locked position of the lock is located partly in the first groove in the lock body and partly in the first slot in the lock cylinder and thereby prevents turning of the lock cylinder relative to the lock body, an auxiliary bar, which in the locked position of the lock is located partly in the second groove in the lock body and partly in the second slot in the lock cylinder, the set of second peripheral notches of each locking disc being arranged in cooperation with said auxiliary bar so that when the locking discs are turned in the opening direction of the lock, said auxiliary bar and said second peripheral notches prevent turning of the locking discs relative to each other at the end phase of the turning movement before the locking bar moves into its position for releasing the lock, and said auxiliary bar being continuously located partly inside the lock cylinder so that it limits the turning range of the locking discs, and at least one member continuously turning with the key and arranged to guide radial movement of the auxiliary bar.

15. A cylinder lock according to claim 14, wherein the second peripheral notches of each locking disc are located between guide surfaces that cooperate with the auxiliary bar for limiting the turning range of the locking disc.

16. A cylinder lock according to claim 14, wherein the part of the auxiliary bar that is continuously located inside the lock cylinder has a tangential extent that exceeds the tangential extent of the second slot in the lock cylinder, whereby the auxiliary bar cannot move through the second slot in the lock cylinder entirely into the second groove in the lock body.

17. A cylinder lock according to claim 14, wherein the second groove of the lock body has a guide surface for pressing the auxiliary bar radially inwards into a channel formed jointly by the second peripheral notches of the locking discs.

18. A cylinder lock comprising:

a lock body having an interior surface formed with first and second grooves, a rotatable lock cylinder inside the lock body, the lock cylinder being formed with first and second slots, a plurality of locking discs enclosed by the lock cylinder, each locking disc having a key engagement surface that is engaged when the key of the lock is inserted in the lock and is turned, and also having a peripheral locking notch that is at one of a predetermined number of permitted angular positions relative to the key engagement surface of the disc, the permitted angular positions all being within a predetermined angular range and being at a predetermined angular pitch within said angular range, said plurality of locking discs comprising first and second sets of locking discs, and each locking disc of the first set having a set of second peripheral notches arranged side by side and located outside said predetermined angular range, the number of second peripheral notches in each locking disc of the second set being equal to said predetermined number and the angular pitch between the second peripheral notches being substantially equal to said predetermined angular pitch, and the second set of locking discs comprising at least one O-locking disc having a peripheral relief of which the tangential extent corresponds to the tangential extent of the set of second peripheral notches in each locking disc of the first set, a locking bar, which in the locked position of the lock is located partly in the first groove in the lock body and partly in the first slot in the lock cylinder and thereby prevents turning of the lock cylinder relative to the lock body, and an auxiliary bar that is guided radially by the second set of locking discs and which in the locked position of the lock is located partly in the second groove in the lock body and partly in the second slot in the lock cylinder, the set of second peripheral notches of each locking disc of the first set being arranged in cooperation with said auxiliary bar so that when the locking discs are turned in the opening direction of the lock, said auxiliary bar and said second peripheral notches prevent turning of the locking discs of the first set relative to each other at the end phase of the turning movement before the locking bar moves into its position for releasing the lock, and said auxiliary bar being continuously located partly inside the lock cylinder so that it limits the turning range of the locking discs.

19. A cylinder lock according to claim 18, wherein said O-locking disc allows movement of the auxiliary bar into a channel formed jointly by said second peripheral notches of the locking discs of the first set only after turning of said O-locking disc close to the position for releasing the lock.

20. A cylinder lock according to claim 19, wherein said O-locking disc of the second set allows movement of the auxiliary bar into the channel formed jointly by the second peripheral notches of the locking discs of the first set when said O-locking disc is at an angle in the range from about 10° to 20° from the position for releasing the lock.

21. A cylinder lock according to claim 18, wherein the second set of locking discs comprises first and second O-locking discs, and wherein the locking discs of the first set are placed between the first and second O-locking discs.

* * * * *